US008591674B2

(12) United States Patent
Mishra et al.

(10) Patent No.: US 8,591,674 B2
(45) Date of Patent: Nov. 26, 2013

(54) MAKING DUCTILITY-ENHANCED MAGNESIUM ALLOY SHEET MATERIALS

(75) Inventors: Sushil Kumar Mishra, Karnataka (IN); Shashank Tiwari, Bangalore (IN); Asim Tewari, Maharashtra (IN); Jon T. Carter, Farmington, MI (US); Deepika Sachdeva, Bangalore (IN)

(73) Assignee: GM Global Technology Operations LLC, Detroit, MI (US)

( * ) Notice: Subject to any disclaimer, the term of this patent is extended or adjusted under 35 U.S.C. 154(b) by 70 days.

(21) Appl. No.: 13/294,259

(22) Filed: Nov. 11, 2011

(65) Prior Publication Data

US 2013/0118657 A1 May 16, 2013

(51) Int. Cl.

| | |
|---|---|
| ***C22C 23/00*** | (2006.01) |
| ***C22C 23/02*** | (2006.01) |
| ***C22C 23/04*** | (2006.01) |
| ***C22F 1/06*** | (2006.01) |

(52) U.S. Cl.
USPC ..... 148/420; 148/406; 148/667; 420/407; 420/408; 420/409

(58) Field of Classification Search
USPC ..... 148/667, 406, 420, 666; 420/402–414
See application file for complete search history.

(56) References Cited

U.S. PATENT DOCUMENTS

| | | | | |
|---|---|---|---|---|
| 1,941,608 | A * | 1/1934 | Lowry et al. | 148/667 |
| 2005/0067068 | A1 * | 3/2005 | Shimizu et al. | 148/667 |
| 2008/0279715 | A1 * | 11/2008 | Mori et al. | 420/408 |

* cited by examiner

*Primary Examiner* — Deborah Yee
(74) *Attorney, Agent, or Firm* — Reising Ethington P.C.

(57) ABSTRACT

A method of enhancing the ductility of magnesium alloy sheets containing 85% or more by weight of magnesium is described. An annealed, substantially strain free, sheet of generally uniform grain size is locally deformed in local regions to develop strained 'islands' of a predetermined strain embedded in a substantially strain-free matrix and then annealed. The deformed regions undergo recrystallization and grain growth while the remainder of the sheet suffers only minor change in grain size, leading to sheet with grains having a bimodal size distribution. The ductility of alloys processed in this way is significantly greater than the ductility of the unprocessed, uniform grain size alloy without compromise to the tensile strength of the alloy.

18 Claims, 4 Drawing Sheets

MAKING DUCTILITY-ENHANCED MAGNESIUM ALLOY SHEET MATERIALS

TECHNICAL FIELD

This invention pertains to methods of processing hot-rolled and annealed magnesium-based alloy sheet materials to obtain enhanced room temperature ductility in the material without reduction of its tensile strength.

BACKGROUND OF THE INVENTION

There is continuing interest in reducing vehicle weight. One approach to weight reduction has been the substitution of higher strength-to-weight sheet materials for the steels and aluminum alloys now commonly used in vehicle construction.

The low density and reasonable strength of magnesium and alloys containing, for example, 85% by weight or more of magnesium, make them attractive candidates for such material substitution. However, magnesium alloys are not as ductile as steel and aluminum and so stamping or shaping such sheet magnesium alloys into the complex shapes of components in common use may be challenging. While the ductility of magnesium alloys may be enhanced by deformation at temperatures appreciably above room temperature, say 250° C. or higher, such practices complicate and slow the forming process.

What is required is a method of enhancing the room temperature formability or ductility of magnesium to expand and extend the use of magnesium sheet alloys in high volume vehicle production.

SUMMARY OF THE INVENTION

In general, practices of this invention start with a magnesium-based alloy sheet that has been annealed or otherwise prepared with a microstructure that is substantially free of strain (e.g., containing fewer than about $10^8$ dislocations per square centimeter). A magnesium alloy sheet is lightly deformed to introduce small local strained volumes or 'islands' distributed and embedded in an otherwise substantially strain free matrix. The sheet, with its distribution of strained and unstrained sheet regions, is then annealed, for example by holding for about 30 minutes at about 350° C. After such processing, the sheet exhibits significantly enhanced ductility, relative to the original sheet, but is of comparable strength.

In an embodiment a substantially strain free magnesium alloy sheet is deformed, without heating, by rolling the sheet between roughened rolls adjusted so that only the high points of the rolls contact and deform the opposing surfaces of the sheet. By appropriately adjusting the height and distribution of high points on the rolls a suitable distribution and scaling of deformed and substantially undeformed regions may be imparted to the sheet to achieve a distribution of strained 'islands' in an otherwise substantially strain free sheet volume. In a second embodiment a similarly substantially strain free magnesium alloy sheet is deformed, without heating from its ambient room temperature, by uniformly reducing its thickness by up to about 4% by rolling between smooth rolls. This practice may likewise be effective in introducing the desired distribution of strained 'islands' in an otherwise substantially strain free sheet volume due to the tendency of magnesium to deform inhomogeneously.

The effectiveness of the procedure may be understood by consideration of the following example. A sample of AZ31 magnesium alloy (nominally 3% by weight aluminum, 1% by weight zinc, balance magnesium and common impurities) when tested in tension at room temperature, about 25° C., using sub-size, 25.4 millimeter gage length tensile samples, exhibited a measured total elongation of about 17% and a tensile strength was about 275 MPa. Another sample of AZ31 alloy of like initial microstructure, after the above-described ductility-enhancing processing comprising introducing regions of local deformation followed by annealing, exhibited a total elongation of about 28% and a tensile strength of about 275 MPa.

Some appreciation of how such methods may be effective in enhancing the ductility of magnesium sheet may best be understood by consideration of the microstructure of the sheet.

In general, structures fabricated of metals and alloys consist of space-filling assemblages of individual crystals, or grains, each of which is oriented differently from its neighboring grains. Typically the grains are much smaller than any of the dimensions of the structure and so the detail of the structure, at the level of the grains, is referred to as its microstructure. The microstructure may be modified or manipulated and any modifications to the microstructure will affect the properties of the metal or alloy.

Magnesium alloy sheet products are most frequently prepared from cast ingots or continuously cast slabs which are progressively reduced in thickness by rolling at temperatures above about 315° C. so that the sheet anneals as it cools down. In addition to imparting the desired thickness change, rolling has the beneficial effect breaking down and refining the as-cast microstructure and reducing the grain size. Often the grains in the rolled and annealed sheet are generally uniformly sized and equiaxed, that is, when viewed in section, their extent does not depend in any systematic way on the orientation of the measurement. A magnesium alloy with a microstructure consisting of generally small, about 20 micrometers or so, substantially uniformly-sized equiaxed grains, may be transformed, by application of the practices of the invention, to form a different microstructure which conveys improved ductility. The strength of the two structures however is only imperceptibly different. This is a remarkable result since most metallurgical techniques for enhancing ductility also reduce strength.

This ductility-enhancing microstructure also contains equiaxed grains, but the grain size distribution is bimodal, that is it contains a generally narrowly distributed mixture of larger grains with an average size and smaller grains, also generally narrowly distributed, of a lesser average size. Local, substantially uniformly spaced, regions of large grain size are intimately mixed with, and surrounded by, regions of predominantly small grain size. The large grain size regions are spaced apart by about 500 micrometers or so within a larger volume of smaller grains. In a suitable proportion, the volume of small grains may about twice the volume of large grains In the exemplary application of the invention summarized previously, the AZ31 magnesium alloy which exhibited a total elongation of about 17% had a generally uniform grain size of about 20 micrometers. The second sample of the AZ31 alloy, processed in accordance with the practices of the invention, and exhibiting a total elongation of about 28%, had a bimodal grain distribution consisting of regions of large grain size spaced apart by about 500 micrometers in a larger volume of smaller grains. About 50% of the grains had a grain size of between about 5 and 25 micrometers and about 25% of the grains ranged in size from about 70 micrometers to about 100 micrometers with the remainder generally uniformly distributed in the range from 25 to 70 micrometers.

Conventional processing schemes for metals and alloys in general, and for magnesium in particular, do not produce such a bimodal grain distribution. But such a bimodal grain size distribution may be obtained by lightly deforming only selected regions of the magnesium alloy sheet, preferably to a critical strain of from between about 3% to about 7% strain while leaving the remaining portions of the sheet substantially undeformed and then, annealing the sheet. A typical annealing time is about 30 minutes and annealing temperatures of between 350° C. and 515° C. have resulted in a bimodal grain size distribution and resulted in improved ductility. The greatest ductility improvement, achieved without significant (less than 2% or so) loss of tensile strength, resulted from using an annealing temperature of 350° C. Higher annealing temperatures of 450° C. and 515° C. yielded lesser, but comparable, ductility improvements but these ductility improvements were accompanied by a loss in tensile strength of about 10% or so.

This preferred distribution of bimodal grains is achieved by a sequential two-step process. First, locally deforming some regions of the volume of sheet material, but not others, and then annealing the sheet. Early in the annealing process the microstructure in the locally deformed regions is first transformed into small strain free grains, or nuclei. With continued annealing some of these nuclei then grow into large grains by absorbing other nuclei. In the undeformed regions of the sheet the effect of annealing is to modestly increase the grain size but the grains remain equiaxed and of generally uniform size. The final microstructure thus consists of local regions of large grains distributed within a fine-grained microstructure. Since the strained regions are the source of the large-grained regions, in general, the scale and distribution of the large-grained regions will substantially mirror the scale and distribution of the local deformations. Suitably, the large grained regions may be generally uniformly dispersed in the fine-grained microstructure and spaced about 500 micrometers or so apart.

The local or inhomogeneous deformation may be imposed by any convenient means provided it leads to dispersed deformed regions embedded in substantially deformation-free regions, and separated by about 500 micrometers or so. Deformation should also be conducted at a low temperature, generally below about 160° C. or so to inhibit recrystallization. Examples of suitable deformation processes include the smooth roll or roughened roll rolling procedures already described. Yet further processes for inducing inhomogeneous deformation include shot blasting or peening, and flex rolling or reverse bending, as well as combinations of such approaches.

The practices of the invention may be applied to single phase magnesium-based alloys and to alloys containing second phases. If the second phases are present as discrete particles, these particles may themselves promote the development of the desired inhomogeneous distribution of strain in the alloy.

Annealing after deformation may be conducted in a batch or continuous manner, in a reducing atmosphere or under vacuum.

These and other aspects of the invention are described below, while still others will be readily apparent to those skilled in the art based on the descriptions provided in this specification.

DESCRIPTION OF PREFERRED EMBODIMENTS

Application of stamped magnesium alloy sheet components in vehicle bodies may offer opportunity for reducing the mass of such bodies, but the broad application of magnesium alloy stampings is hampered by their limited ductility and formability at low temperatures, or below about 160° C. This reduced low temperature formability, compared to that of the steel and aluminum alloys currently in broad use, limits the complexity of shapes which may be stamped from such alloys.

Magnesium, and typical magnesium alloys with 85% by weight or more of magnesium, have a microstructure consisting of an assemblage of grains, each with a hexagonal crystal structure. Metals may deform by slip along preferred crystallographic planes and directions, each unique combination of plane and direction being termed a slip system. But metals with a hexagonal crystal structure, like magnesium, are limited in the number of available slip systems and may deform inhomogeneously so that regions of intense deformation are separated by regions of minimal deformation. This behavior is believed responsible for the generally poorer ductility of sheet magnesium alloys compared to steel and aluminum sheet alloys.

But, in an embodiment, inhomogeneous deformation of magnesium and its alloys may be promoted, and then exploited to prepare sheet magnesium alloys with appreciably more ductility than the sheet magnesium alloys currently available.

Figure 1:
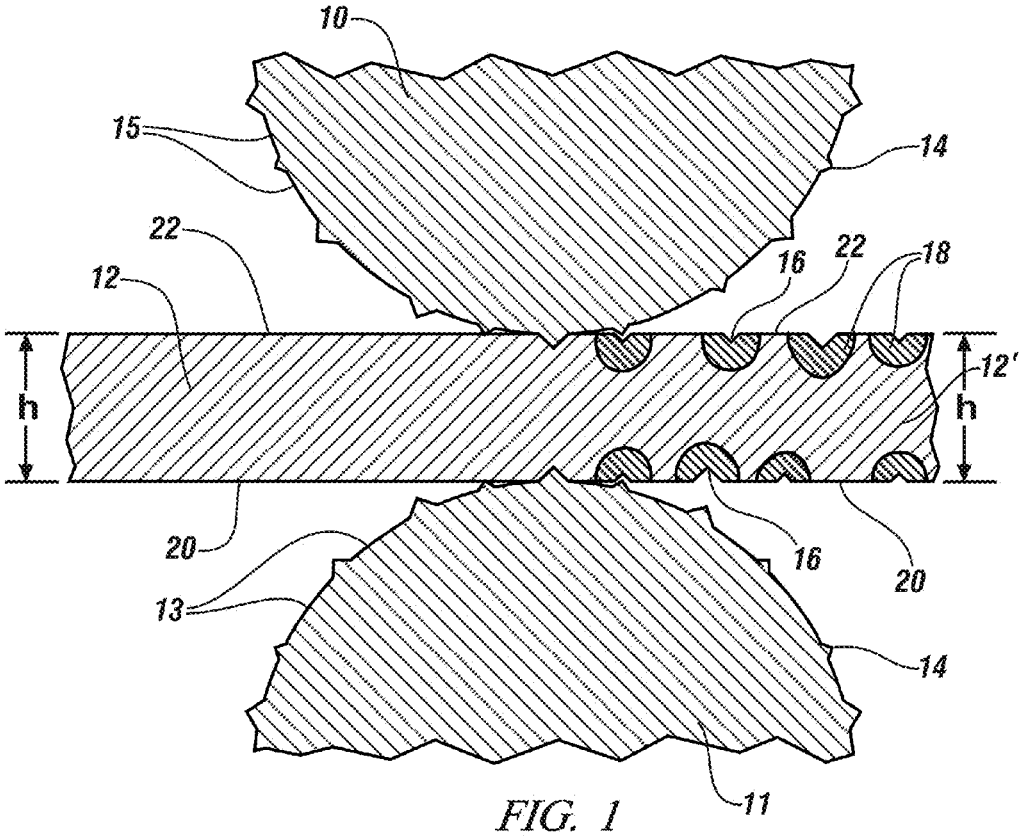
FIG. 1 schematically illustrates, in cross-section view, a rolling process employing roughened rolls and suited for developing non-uniform deformation in a sheet product.

FIG. 1 illustrates, in section, a rolling process employing a pair of opposed rolls 10, 11 which is adapted to impart deformation to only selected regions of a magnesium alloy sheet 12 of thickness h. The rolls incorporate cylindrical segments 13, 15 separated by radially outwardly-extending projections or protrusions 14. The maximum height or extent of the protrusions should not exceed about 10% of the sheet thickness. Preferably the protrusions may range from 2-5% of the sheet thickness. The protrusions may be effective over a wide range of shapes and spacings and their depiction in FIG. 1 is intended to be illustrative and not limiting.

Rolls 10, 11 are set so that their cylindrical segments 13, 15 are spaced apart by a distance just equal to the thickness h of the incoming sheet 12. Thus the overall thickness of the exiting sheet will also equal h and no global reduction in the thickness of sheet 12 will occur. However, because protrusions 14 extend to a greater radial distance than the cylindrical segments 13, 15, the protrusions 14 will engage the upper 22 and lower 20 surfaces of sheet 12. In engaging the sheet surfaces 20, 22 the protrusions 14 will create indentations 16 on the sheet surfaces 20, 22. Each of indentations 16 will have an associated deformed region 18 surrounding the indentation. The nature and extent of the deformed region will be analogous to that obtained when conducting a hardness test so that the deformation will be of limited extent and, particularly, will not extend to the opposing sheet surface.

It will be appreciated that, in practice, it will be challenging to achieve the set-up shown in FIG. 1 due to expected manufacturing variation and tolerance. Some examples, among many others, of such variations include; the sheet thickness may exhibit some thickness variation; or the rolls may show some deviation from a cylindrical form; or the rolls may not be parallel; or the roll rotational axis may be displaced from the true roll center. Hence, even with roughened rolls the rolls may be set to achieve about 1% reduction in thickness to assure that the entire sheet surface experiences this local deformation even with such process variation.

Figure 2:
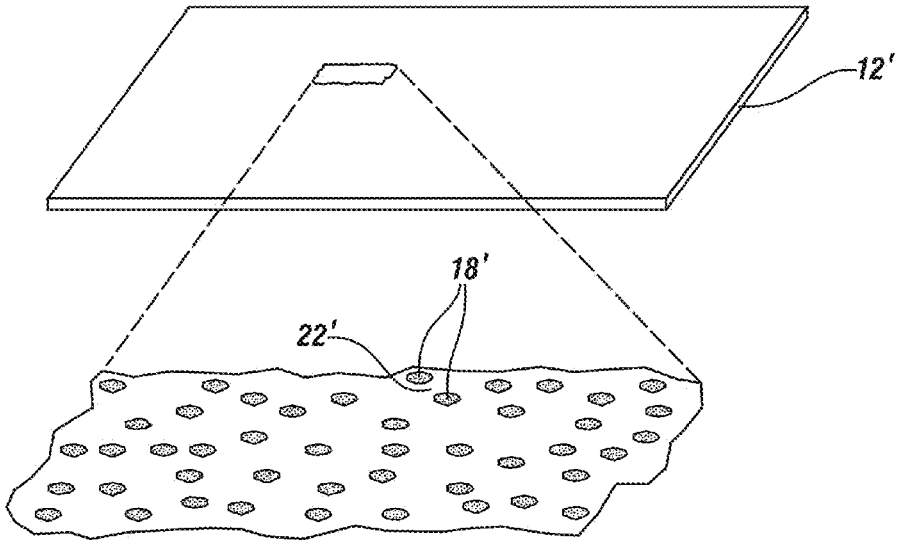
FIG. 2 shows, in perspective view a portion of one surface of the rolled sheet of FIG. 1, schematically illustrating the distribution of deformed regions on the sheet surface.

Typically the pattern of protrusions 14 will vary across the width of the roll so that a more or less uniform distribution of spaced-apart deformed regions is formed on the surface(s) of the sheet 12'. A representation of such an array of deformed regions 18' separated by undeformed surface regions 22' is shown in FIG. 2.

A number of procedures may be employed to impart protrusions to initially smooth rolls. For example, roll roughening may be conducted using lasers, following procedures well known to those skilled in the art. Such laser roll roughening may be applied in a programmed and controlled fashion to create regularly-patterned rolls with peaks and valleys scaled to impart the desired strain levels. More random roll patterns may be introduced by other roll roughening processes such as shot peening to produce a substantially random distribution of deformed regions on the sheet as illustrated in FIG. 2.

On shot peened rolls the relative heights of the peaks and valleys may be adjusted by varying the mass of the shot and the slinger velocity. Again, since the objective is to impart a pre-determined strain to the sheet the roughness of the rolls should be scaled or proportioned to the thickness of the sheet.

Other processes for introducing local deformation confined within specific sheet regions may include flex rolling, temper rolling or roller leveling. In application of these process, the deformation may be progressively decreased as the sheet passes through the roll sets. Asymmetric or shear rolling in which the rolls rotate at differing speeds may also be effective.

Figure 3:
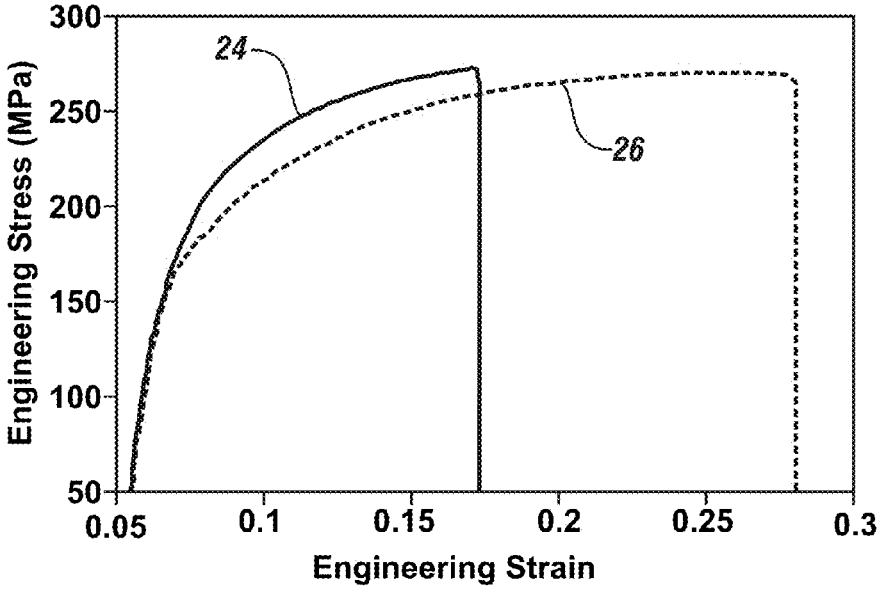
FIG. 3 shows graphs of (Engineering) Stress versus (Engineering) Strain comparing the tensile stress-strain behavior of a magnesium sheet prior to and subsequent to ductility-enhancing processing comprising introducing regions of local deformation, for example as shown in FIGS. 1 and 2, followed by annealing.

By annealing outgoing sheet 12' (FIGS. 1, 2), for example by holding the sheet at a temperature of about 350° C. for about 30 minutes, the ductility of annealed outgoing sheet may be appreciably increased over the incoming sheet material 12 of FIG. 1. A comparison of their stress-strain responses is shown in FIG. 3. Curve 24 is representative of the behavior of the incoming sheet while curve 26 shows the behavior of the rolled sheet 12' after annealing. In both cases the tensile strength is about 275 MPa but the material processed according to the practices of the invention, exhibits a significantly greater total elongation of about 28% versus the total elongation of about 17% shown by the incoming sheet.

Figure 4:
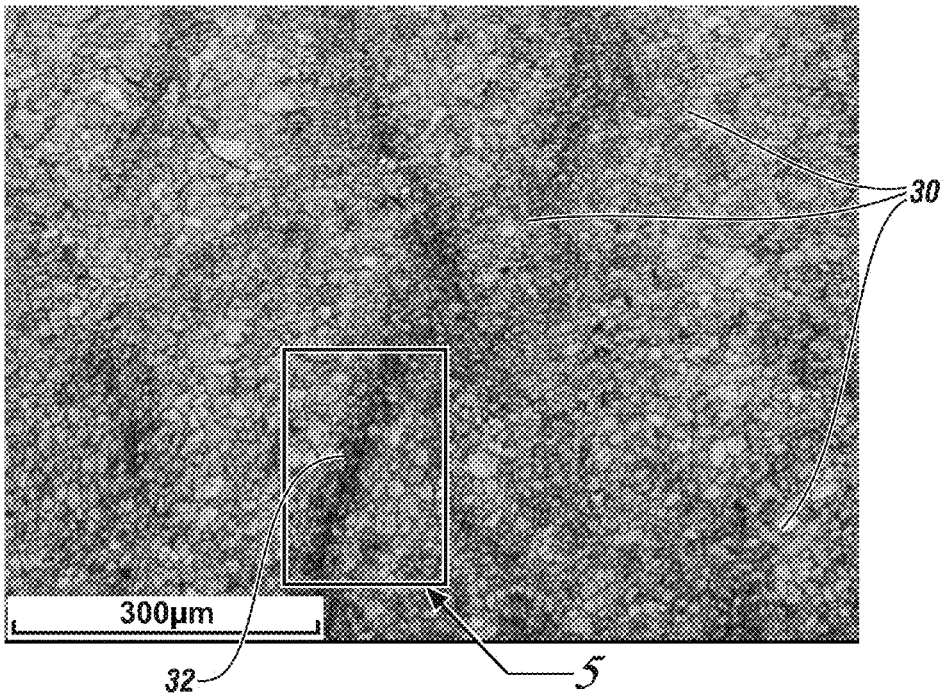
FIG. 4 shows the microstructure, obtained using electron backscatter diffraction (EBSD) on a polished section through the thickness of an annealed AZ31 alloy specimen after limited tensile deformation. A generally uniform fine grained structure with dark regions indicative of shear banding may be observed. A portion of the microstructure, outlined in white, is shown at higher magnification in FIG. 5.
Figure 5:
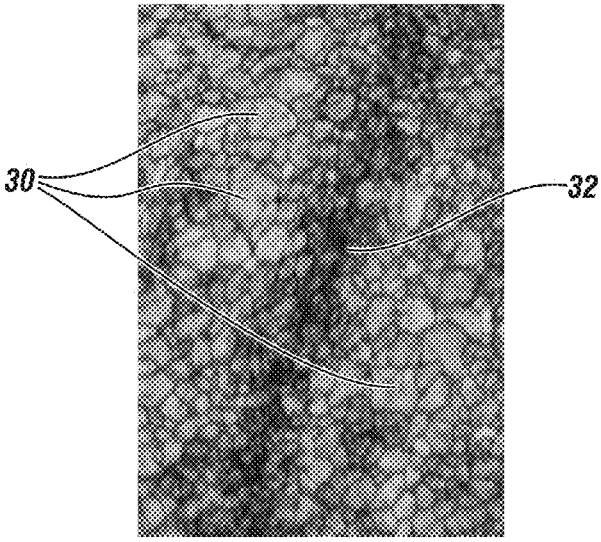
FIG. 5 shows a portion of the microstructure of FIG. 4 at higher magnification to better define the grain structure and the nature of the shear bands.

The effect of such a rolling practice on the microstructure in a sheet magnesium AZ31 alloy sample is shown in FIG. 4. A portion of FIG. 4, shown as outlined, may be viewed at higher magnification in FIG. 5. The microstructure consists of more or less equiaxed grains 30 (best seen in FIG. 5), each about 20 micrometers of so in size and is typical of a commercial, annealed magnesium alloy sheet 'as-received' from a supplier. In some elongated, narrow zones 32 which appear darker, the grains are intensely deformed, while in regions adjacent to these intensely deformed zones the microstructure shows little evidence of deformation. The deformed zones 32, commonly termed shear bands, may propagate lengthwise to extend over appreciable distances. Continued deformation will tend to intensify the deformation in the shear bands and eventually promote failure of the sample even though much of the sample may have experienced significantly less deformation than the shear bands.

The microstructure shown in FIG. 4, and in all subsequent micrographs, was obtained using electron backscatter diffraction (EBSD) techniques. Through-thickness samples were removed from the sheet or tensile sample without introduction of further deformation by using a low-speed precision diamond saw. One surface of the sample was prepared for electron backscatter diffraction (EBSD) by mechanically polishing the surface with progressively finer oil-based diamond suspensions down to 0.25 micrometers in size, followed by polishing with 0.05 micrometer colloidal silica. EBSD data was acquired using a ZEISS field emission gun scanning electron microscope with an HKL Channel-5 camera and the sample surface was inclined at 70° to the incident electron beam.

Some of the electrons incident on a crystalline sample are back scattered, that is scattered or redirected in a direction opposite the incident electron beam, without appreciable loss in energy. Some of these back scattered electrons are redirected only after they have penetrated into the sample and as these scattered electrons exit the sample they may further interact with the crystal by being diffracted by the atomic planes of the crystal to form an observable diffraction pattern. The less the deformation in a grain the more perfect the diffraction pattern will be. Thus by scanning or stepping the electron beam across a polycrystalline sample and examining the perfection of the diffraction pattern, the extent of deformation in different regions of the sample may be assessed.

If the size of the electron beam is less than the grain size, the deformation associated with a particular grain may be identified and if the beam size is very small, the disordered grain boundaries may also be identified. In the microstructures shown the spatial resolution is 0.5 micrometers or less. By representing undeformed grains as white and deformed grains as black and assigning some number of intermediate intensity levels, an image representing the qualitative levels of deformation in every grain in the sample surface can be constructed as shown in FIG. 4.

Figure 6:
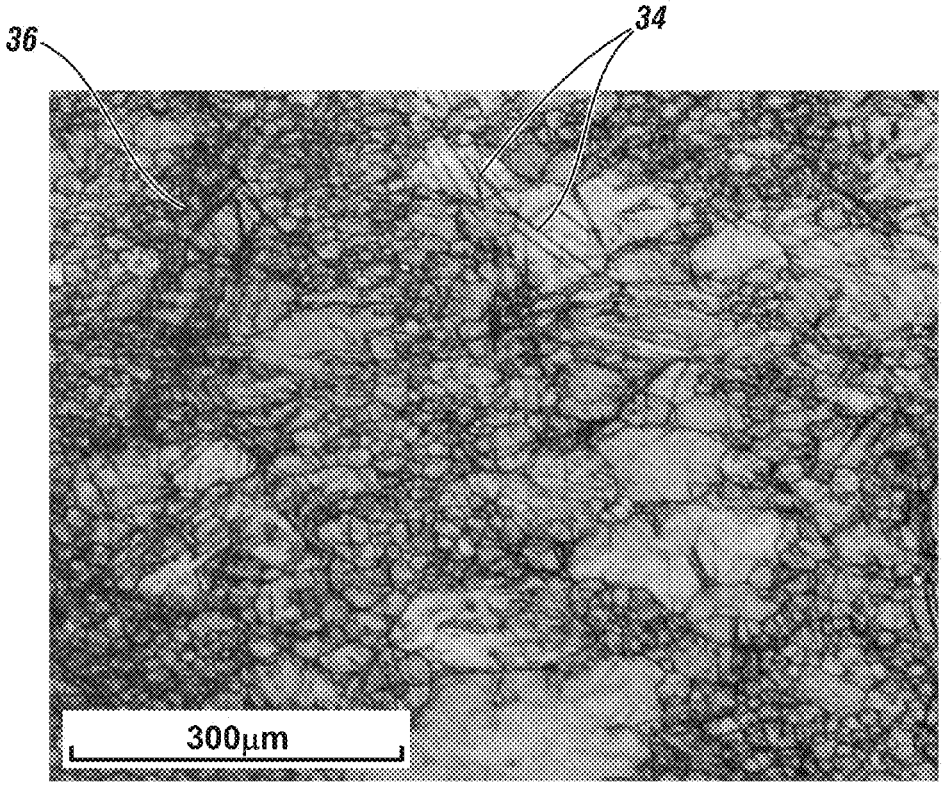
FIG. 6 shows the microstructure, through the thickness revealed by EBSD, of a polished AZ31 alloy after processing to develop a bimodal distribution of grain sizes by non-uniformly deforming the sample and annealing at 350° C. for 30 minutes. The sample has been deformed and twinning may be seen in some of the larger grains.

Annealing the structure of FIG. 4 forms a bimodal grain structure, an example of which is shown in FIG. 6. The structure no longer consists of generally uniformly sized equiaxed grains but rather of generally equiaxed grains which fall into one of two size categories—a bimodal grain size distribution.

The structure shown in of FIG. 6 has been deformed after annealing to develop its bimodal grain size structure and may be generally interpreted analogously to the image of FIG. 4. A unique feature shown in FIG. 6 is that some twins are present. Twinning is a second mode of deformation exhibited by crystalline solids and involves a deformation-induced atomic rearrangement within the crystal so that across a particular crystallographic plane, the twin plane, the atoms are in mirror-reflection positions on each side of the twin plane. Twins usually appear as two parallel near-straight lines extending across the width of the grain. Note that in FIG. 6, some tendency toward shear banding may be observed within the smaller grains, for example at 36, and twins 34 are clearly visible in several of the larger grains.

The microstructure shown in FIG. 6 with its superior ductility as shown in curve 26 of FIG. 3 results from the cooperative influence of annealing on an inhomogeneously deformed microstructure such as that shown in FIG. 4. It is known that deformed metals and alloys may recover substantially their undeformed properties by annealing. That is, by heating an alloy to a temperature of about one-half its solidus temperature or higher, in Kelvin, and holding it at temperature for a period ranging from about 10 minutes to two hours or so. Annealing undoes the effects of deformation and generates an assemblage of new, strain-free grains, a process known as recrystallization.

Recrystallization occurs in a number of steps. Initially small new grains or nuclei form at preferred sites in the deformed region and these nuclei then grow, consuming or absorbing the deformed grains. Growth is competitive and when each of the nuclei has consumed the deformed grains surrounding it and encounters or collides with a neighboring growing nucleus the process slows, leaving a space-filling structure of strain free grains. Continued annealing will promote a general coarsening of the grain structure and lead to at least an overall increase in grain size, as well as modifying the size distribution.

The number and size of the strain-free gains depends primarily on the number of nuclei formed in the early stages of the process. After intense deformation many closely-spaced nuclei form and only limited growth can occur before they encounter one another or collide, leading to a fine-grained structure. Unstrained regions undergo substantially no recrystallization although some grain coarsening may occur. But, at a critical strain, recrystallization will begin from a few, more widely-spaced, nuclei each of which can undergo extensive growth before collision occurs, leading to a much more coarse-grained structure.

So, the desired bimodal grain size distribution shown in FIG. 6 requires a cooperative interaction between the deformation and annealing steps. The starting material preferably has a relatively uniformly initial grain size. The starting material may then be deformed to introduce suitably spaced apart strained regions immersed in substantially undeformed regions.

When such a deformed sheet is annealed, no nuclei will form in the undeformed regions and only limited grain growth will result leading to only minor changes in the grain size and distribution in these regions. However, the small number of nuclei formed in the strained regions will grow extensively to produce large grains. These behaviors in the deformed and undeformed regions will promote the desired bimodal grain size. Since the large grains will form only in the originally strained regions the desired grain distribution may be enforced by controlling the size and distribution of the deformed regions.

Review of FIG. 6, and making use of the metallographic relationship that the area fraction of an entity measured on a flat plane section is equal to its volume fraction, it appears that about $\frac{2}{3}^{rd}$ of the volume is occupied by fine grains and about $\frac{1}{3}^{rd}$ by coarse grains. A more precise analysis suggest that: about 50% of the volume fraction is fine grained with a grain size of between 10 and 25 micrometers; about 25% of the volume fraction is coarse grained with a grain size of between about 70 and 100 micrometers; and that the remaining volume fraction is occupied by grains of between about 25 and 70 micrometers, that is, grains sized between the limits of the small and large size ranges of the bimodal distribution.

Figure 7:
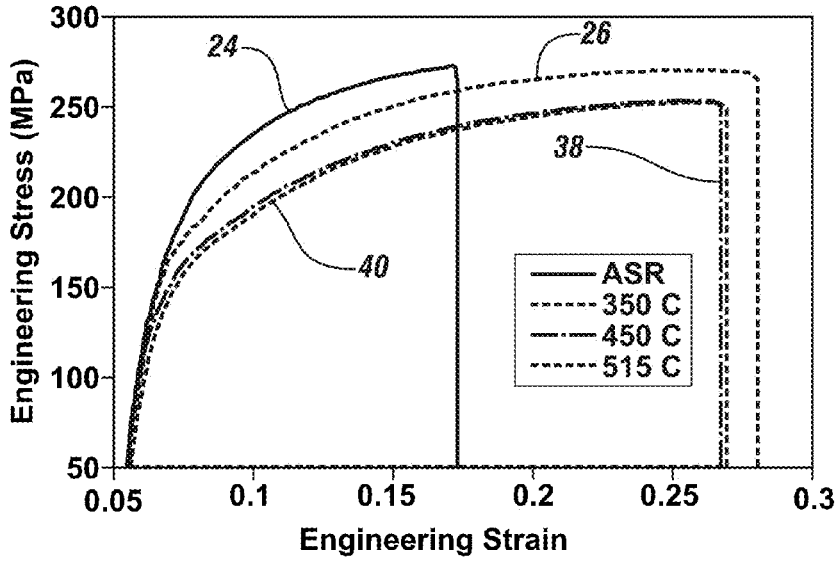
FIG. 7 shows graphs of (Engineering) Stress versus Engineering Strain for non-uniformly strained AZ31 samples after annealing for 30 minutes at temperatures of 350° C., 450° C. and 515° C. for 30 minutes. The behavior of an as-received (ASR) sample with the grain structure of FIG. 4 is shown for comparison.

Numerous time and temperature combinations may be used to anneal the sheet, but not all annealing processes yield equivalent results. FIG. 7 reproduces the results of FIG. 4 while adding the stress-strain response of deformed samples annealed for 30 minutes at 450° C., curve 38, and for 30 minutes at 515° C., curve 40. Although the total elongation of ~27% is still greater than that of the 'as-received' material (curve 24) it is less than was obtained using 30 minutes at 350° c. for the anneal (curve 26). But note that while the tensile strength of the 350° C. annealed sample (curve 26) is near-identical to that of the as-received sample (curve 20), both samples annealed at 450° C. and 515° C. have lower tensile strengths (curves 38 and 40). This is consistent with a significantly greater proportion of coarse grains which will be developed in these microstructures due to the higher annealing temperatures.

Rolling the sheet with roughened rolls imposes the desired strain distribution on the sheet geometrically since only some locations on the rolls are capable or imparting deformation. But, magnesium is prone to deform inhomogeneously even under conditions which might be expected to promote uniform deformation, such as smooth roll rolling deformation.

Figure 8:
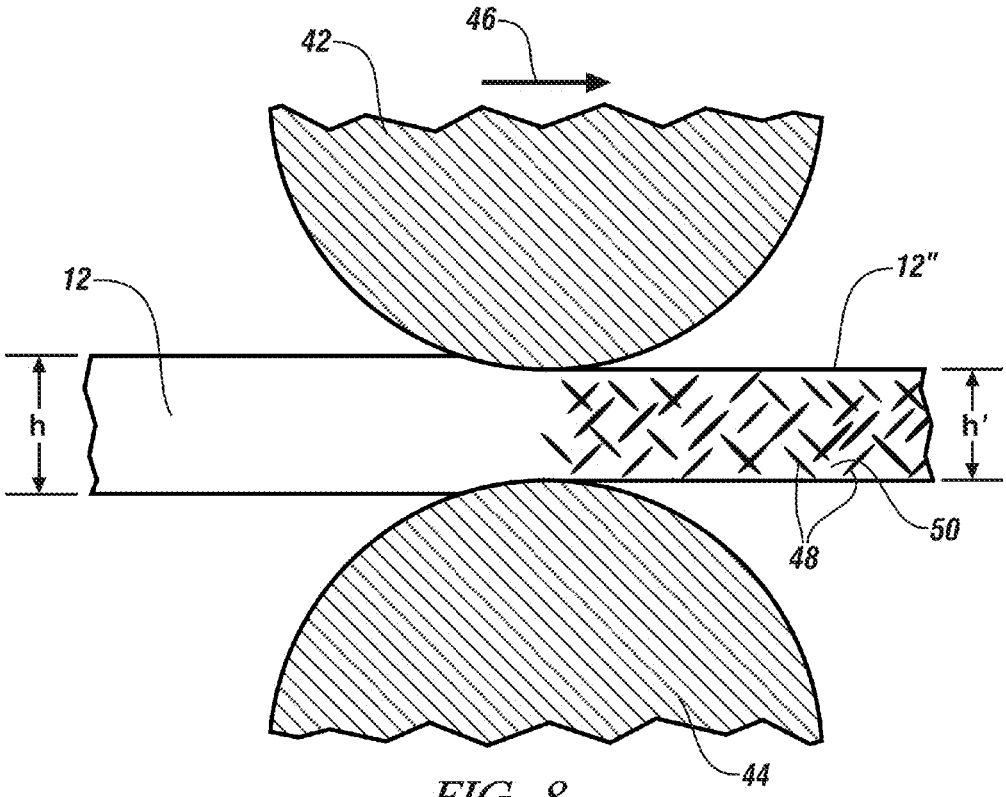
FIG. 8 shows, in cross-section, a schematic rolling process for reducing a magnesium sheet in thickness by between about 2% and 4% from in incoming thickness of h to an outgoing thickness of h' using smooth rolls to produce locally-deformed regions in a generally undeformed sheet volume.

FIG. 8 schematically shows a magnesium alloy sheet subjected to a modest reduction in thickness by rolling with smooth rolls. The rolls 42, 44 are rotated such as to advance the annealed or undeformed incoming sheet 12 in the direction indicated by arrow 46. The relative positions of the rolls are adjusted to reduce the thickness h of incoming sheet 12 to a thickness h', so that the thickness of outgoing sheet 12" is less than that of incoming sheet 12.

At low reductions in thickness, of say between about 2% and 5%, the magnesium sheet will deform inhomogeneously so that outgoing sheet 12" contains strained local regions, or islands 48, dispersed in a substantially unstrained volume. Thus strained regions 48 are separated by substantially unstrained regions like that shown at 50. This distribution of strained and unstrained regions will manifest itself across the sheet width in a manner similar to that as illustrated in FIG. 2.

To achieve the desired bimodal grain size distribution, the strained regions in which nuclei form, should exhibit strains of between 3 and 7% and be present in suitable number and density. The prescribed overall strain of between 2 and 5% is effective in producing, in the strained regions 48, the required strains of between about 3 and 7% with generally unstrained regions between. The relative fractions of strained and unstrained regions are such as to develop a volume-weighted average strain equal to the imposed average strain of between 1 and 4%. Rolling is a convenient method of achieving the desired average strains but, in principle, any deformation mode, tensile, compressive, bending or shear may be used. Bending, because it inherently introduces a strain gradient in the sheet, may be more forgiving of sample to sample processing variations. The sheet may be processed as individual cut sheets or as continuous coil.

Since the magnesium is in sheet form, the most convenient deformation process would be rolling between either roughened rolls or smooth rolls as previously described. In sheet form, cross-rolling, or rolling across the sheet width, may be employed but continuous coil products may be rolled only along the coil length. In all cases deformation should be carried out at low temperature, here considered to be below about 160° C., a temperature at which recrystallization may occur. The locally-strained regions imparted during rolling may be readily achieved using only a single pass, or a single passage of the sheet through the rolls, and no further benefit is obtained by using multiple passes.

The subsequent annealing process may be performed as a batch or a continuous process, often, to avoid oxidation of the magnesium alloy, under vacuum or inert atmosphere. Short-time high temperature annealing schedules may be most suited for continuous processing while longer-time, lower temperature annealing schedules may best be practiced in batch mode. While the results presented previously should be viewed as illustrative and not limiting it appears than an annealing schedule of about 350° C. for a period of about 30 minutes promotes appreciable improvement in ductility without loss of strength.

In a particular exemplary practice of the invention, commercial AZ31 alloy magnesium sheets were obtained in H24 temper. In this temper the sheet is only partially annealed, and the sheet was first annealed by holding at 350° C. or so for about 15 minutes and air cooling to create an equiaxed fine-grained microstructure. The annealed sheet was then rolled, using roughened rolls, in a single pass, at room temperature to minimally reduce its thickness, by about 1% or so, to ensure that all elevated portions of the rolls engaged the sheet surface. After this treatment the sheet microstructure was representative of that shown in FIGS. 4 and 5. The deformed sheet was then annealed for about 15 minutes at about 350° C. or so to develop a microstructure similar to that shown in FIG. 6 and properties like that shown as curve 26 in FIG. 3.

Magnesium alloy AZ31 has sufficient concentrations of aluminum and zinc that it may be expected to contain particles of $Mg_{17}(Al,Zn)_{12}$ after annealing. No such particles are evident in the micrographs shown as FIGS. 4, 5 and 6 but this may be due to the instrument operating conditions which resulted in an instrument resolution of less than 0.5 micrometers. So, small particles, of say 0.2 micrometers or smaller, would not be detected. The presence of coarser particles, such as may be present in more highly alloyed magnesium alloys may not be detrimental to the practice of the invention. In fact, the presence of such coarser particles would facilitate the practice of the invention, since, when alloys containing coarser particles are deformed, more extensive deformation occurs in the vicinity of the particle. That is, the presence of the particle promotes the pattern of inhomogeneous deformation which enables, after annealing, the development of the bimodal grain size distribution demonstrated to improve room temperature ductility. Hence the effective practice of the invention is not limited to only AZ31 alloy or to single (or apparently single) phase magnesium alloys but is broadly applicable to magnesium-based alloys in general.

The practice of the invention has been illustrated through reference to certain preferred embodiments that are intended to be exemplary and not limiting. The full scope of the invention is to be defined and limited only by the following claims.

The invention claimed is:

1. A method of improving the room temperature tensile elongation of a magnesium-based alloy sheet with a thickness, the sheet having an initial annealed microstructure comprising strain-free grains of substantially uniform size, by forming in the sheet a microstructure comprising grains of two distinguishable size ranges, the method comprising:

deforming the sheet, in a single rolling operation at a temperature no higher than about 160° C. to distribute, the deformation producing a substantially uniform distribution of closely-spaced, strained, portions of the sheet embedded in substantially undeformed sheet portions; and annealing the sheet at a temperature and for a time suitable for producing, in the strained, closely-spaced, embedded portions, grains larger than the grains in the substantially undeformed sheet portions to develop a microstructure in which the grain sizes comprise a bimodal distribution in which a majority of the grains have sizes which lie within one of two size ranges of between about 10 and 25 micrometers and between about 70 and 100 micrometers, the regions with grains of between about 70 and 100 micrometers developing in the previously-strained portions.

2. The method of claim 1 in which the magnesium sheet is deformed by rolling between roughened rolls, the roughened rolls comprising protrusions extending outwardly from the roll surface, the protrusions having a length of less than 10% of the sheet thickness, the rolling being conducted at a temperature below about 160° C. to reduce the sheet thickness by about 1%.

3. The method of claim 1 in which the magnesium sheet is deformed by rolling between substantially smooth rolls without heating the sheet to reduce its thickness by between about 2% and 5%.

4. The method of claim 1 in which annealing temperature is about 350° C. and the annealing time ranges from about 15 minutes to about 30 minutes.

5. The method of claim 1 in which the annealing temperature ranges from about 350° C. to about 500° C.

6. The method of claim 1 in which the closely-spaced strained portions of the sheet are spaced apart by about 500 micrometers.

7. The method of claim 1 in which about 75% of the volume of the sheet contains grains which lie in the size ranges of the bimodal distribution.

8. The method of claim 1 in which a first volume of the sheet comprises grains ranging in size from about 10 to 25 micrometers and a second volume of the sheet comprises grains ranging in size from about 70 to 100 micrometers and the ratio of the first volume to the second volume is about 2:1.

9. The method of claim 1 in which the magnesium alloy is AZ31.

10. A magnesium alloy sheet with a microstructure comprising closely-spaced, and substantially uniformly distributed clusters of grains of a first size range of between about 70 and 100 micrometers embedded within a plurality of grains of a second, smaller size range of between about 10 and 25 micrometers, the sheet having greater tensile ductility and comparable tensile strength than a sheet of the same alloy with a microstructure comprising grains of substantially similar size.

11. The magnesium alloy sheet of claim 10 in which the clusters of grains ranging from 70 to 100 micrometers in size are spaced apart by about 500 micrometers.

12. The magnesium alloy sheet of claim 10 in which a first volume of the sheet comprises grains ranging in size from about 10 to 25 micrometers and a second volume of the sheet comprises grains ranging in size from about 70 to 100 micrometers and the ratio of the first volume to the second volume is about 2:1.

13. The magnesium alloy sheet of claim 10 in which the magnesium alloy is AZ31.

14. A method of improving the room temperature tensile elongation of a magnesium-based alloy sheet with a thickness and an initial microstructure comprising annealed strain-free grains of substantially uniform size, by forming in the sheet a microstructure comprising grains of two differing size ranges, the method comprising:

deforming the sheet by rolling the sheet between roughened rolls comprising protrusions extending outwardly from the roll surface, the protrusions having a length of less than 10% of the sheet thickness, the rolling being conducted in a single pass at a temperature of about 25° C. to reduce the sheet thickness by about 1% to thereby distribute, substantially uniformly, strained portions of the sheet embedded in substantially undeformed sheet portions; and annealing the sheet at a temperature and for a time suitable for producing, in the strained, closely-spaced, embedded portions, grains larger than the grains in the substantially undeformed sheet portions to develop a microstructure in which the grain sizes comprise a bimodal distribution in which a majority of the grains have sizes which lie within size ranges of about from 10 to 25 micrometers and about from 70 to 100 micrometers, the regions with grains of between about 70 and 100 micrometers developing in the previously-strained portions.

15. The method of claim 14 in which the magnesium sheet is deformed by rolling, in a single pass, between substantially smooth rolls to reduce its thickness by between about 2% and 5%.

16. The method of claim 14 in which annealing temperature is about 350° C. and the annealing time ranges from about 15 minutes to about 30 minutes.

17. The method of claim 14 in which the annealing temperature ranges from about 350° C. to about 500° C.

18. The method of claim 14 in which the length of the protrusions ranges from 2% to 5% of the sheet thickness.

* * * * *